US007788090B2

(12) United States Patent
Van De Par et al.

(10) Patent No.: US 7,788,090 B2
(45) Date of Patent: Aug. 31, 2010

(54) COMBINED AUDIO CODING MINIMIZING PERCEPTUAL DISTORTION

(75) Inventors: Steven Leonardus Josephus Dimphina Elisabeth Van De Par, Eindhoven (NL); Nicolle Hanneke Van Schijndel, Eindhoven (NL); Valery Stephanovich Kot, Eindhoven (NL); Richard Heusdens, Delft (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 751 days.

(21) Appl. No.: 11/575,149

(22) PCT Filed: Sep. 2, 2005

(86) PCT No.: PCT/IB2005/052879

§ 371 (c)(1), (2), (4) Date: Mar. 13, 2007

(87) PCT Pub. No.: WO2006/030340

PCT Pub. Date: Mar. 23, 2006

(65) Prior Publication Data

US 2008/0097763 A1 Apr. 24, 2008

(30) Foreign Application Priority Data

Sep. 17, 2004 (EP) ..... 04104514

(51) Int. Cl.
*G10L 19/00* (2006.01)
*G10L 19/02* (2006.01)

(52) U.S. Cl. ..... 704/200.1; 704/201; 704/229; 704/500

(58) Field of Classification Search ..... None

See application file for complete search history.

(56) References Cited

U.S. PATENT DOCUMENTS 4,622,680 A 11/1986 Zinser (Continued)

FOREIGN PATENT DOCUMENTS

EP 0396121 A1 11/1990

(Continued)

*Primary Examiner*—Matthew J Sked

(57) ABSTRACT

An audio encoder in which two or more preferably different encoders cooperate to generate a joint encoded audio signal. Encoding parameters of the two or more encoders are optimized in response to a measure of distortion of the joint encoded audio signal in accordance with a predetermined criterion. The distortion. measure is preferably a perceptual distortion measure. In one encoder embodiment comprising a sinusoidal and a waveform encoder, a constant total bit rate for each audio frame is distributed between the two encoders so as to minimize perceptual distortion for both the first and the second encoder. Other embodiments consider a set of encoding parameters that is larger than only those that minimize the perceptual distortion of the first encoder. In some embodiments, perceptual distortion may be minimized by optimizing encoding via optimizing entire encoding templates, i.e. a complex set of encoding parameters, for the separate encoders. The separate encoders may either be cascaded or operate in parallel, or in a combination of these. Two or more audio segments are preferably taken into account in the optimizing procedure. A corresponding audio decoder comprises separate decoders corresponding to the separate encoders of the audio encoder that encoded the audio signal. Decoded signal parts from these decoders are then added to produce the final audio signal. The presented audio encoding is efficient and provides a high sound quality because the encoding scheme is flexible and adapts to specific demands for each audio excerpt.

17 Claims, 5 Drawing Sheets

U.S. PATENT DOCUMENTS 5,649,052 A * 7/1997 Kim ..... 704/226
5,808,569 A 9/1998 Wuppermann et al.
6,115,688 A * 9/2000 Brandenburg et al. ..... 704/503
6,161,088 A * 12/2000 Li et al. ..... 704/229
6,263,312 B1 7/2001 Kolesnik et al.
6,385,571 B1 * 5/2002 Heo ..... 704/200.1
6,502,069 B1 * 12/2002 Grill et al. ..... 704/219
6,691,082 B1 2/2004 Aguilar et al.
7,136,812 B2 * 11/2006 Manjunath et al. ..... 704/221
7,275,031 B2 * 9/2007 Hoerich et al. ..... 704/230
7,395,211 B2 * 7/2008 Watson et al. ..... 704/500
2003/0220783 A1 11/2003 Streich et al.

FOREIGN PATENT DOCUMENTS

EP 1173028 A2 1/2002

* cited by examiner

COMBINED AUDIO CODING MINIMIZING PERCEPTUAL DISTORTION

FIELD OF THE INVENTION

The invention relates to the field of high-quality low bit rate audio signal coding. The invention particularly relates to effective coding optimized with respect to perceived sound quality, while considering a target bit rate. More specifically, the invention relates to audio signal encoding using a plurality of encoders to produce a joint encoded signal representation. The invention also relates to an encoder, a decoder, encoding and decoding methods, an encoded audio signal, storage and transmission media with data representing such an encoded signal, and audio devices with an encoder and/or decoder.

BACKGROUND OF THE INVENTION

In high-quality audio encoding, it is well known that different encoding methods are necessary to provide an optimal result with respect to sound quality versus bit rate for a large variety of audio signals. One encoding method may provide good results for certain types of audio signals, whereas other types of audio signals result in poor performance. For very low bit rates, a sinusoidal encoder plus a noise model is most efficient, while waveform encoding techniques generally lead to better results for higher bit rates.

In the current MPEG 2 and MPEG 4 standards, the problem is recognized that different encoding strategies may be more efficient for different bit rates. Thus, a large range of different audio encoders is included in this standard, most of which are targeted to give best results for a limited range of bit rates.

However, normal audio signals include a mix of a large variety of signal properties even within a short period of time. It is therefore quite common that even a few seconds of an audio signal comprise short excerpts dominated by, for example, pure tones, noise, or transients. These different characteristics call for different encoding characteristics for optimal encoding, i.e. the use of a single type of encoder may result in quite poor results in terms of bit rate or quality for certain excerpts of the signal.

Ph.D. work by Scott Levine [1] (see the List of References at the end of the section entitled "description of embodiments"), describes an encoder comprising a mix between a sinusoidal (or parametric) encoder and a waveform encoder. The largest part of an audio signal is encoded with a parametric encoder, while a waveform encoder is used only for the transient parts of the audio signal. In this scheme, a predetermined division between the parametric encoder and the waveform encoder is applied.

U.S. Pat. No. 5,808,569 in the name of Philips describes an encoding scheme in which different parts of a signal are encoded by using two different encoding strategies. However, no further specification is given to determine how bit rate is distributed across the different encoders.

No prior-art audio encoder thus addresses the problem of controlling two or more different encoding schemes in response to varying parameters of an audio signal.

OBJECT AND SUMMARY OF THE INVENTION

It is an object of the present invention to provide a flexible audio encoder which is capable of providing high-quality audio encoding with a high efficiency for a large variety of audio signal characteristics and for different target bit rates.

According to a first aspect of the invention, this object is achieved by an audio encoder adapted to encode an audio signal, the audio encoder comprising:

a first encoder adapted to generate a first encoded signal part, at least a second encoder adapted to generate a second encoded signal part, and a control unit comprising evaluation means adapted to evaluate a joint representation of the audio signal comprising the first and second encoded signal parts with respect to a distortion measure, and optimizing means adapted to adjust encoding parameters for at least one of the first and second encoders and monitor the distortion measure of the joint representation of the audio signal in response thereto, so as to optimize the encoding parameters in accordance with a predetermined criterion.

The term 'distortion measure' should be construed as any measure of difference between the audio signal and the encoded audio signal, i.e. the joint representation of the audio signal.

The term 'encoding parameters' should be construed broadly as one or more possible encoding variables that may be adjusted for a specific encoder. The nature of these encoding parameters depends on the type of encoder.

An audio encoder according to the first aspect is capable of adapting optimal encoding for each excerpt of the audio signal so as to best utilize the two joint encoders to obtain the lowest possible perceptual distortion, i.e. the best perceived quality, given a certain maximum bit rate limit. Especially by choosing the first and second encoders so that they use completely different encoding principles will provide an efficient encoding. For example, for one excerpt with certain signal characteristics, the most efficient encoding may be obtained almost solely with the total bit rate used by the first encoder, while the next excerpt exhibits different characteristics requiring a mix of both encoders for optimal encoding. The encoder according to the first aspect is capable of adapting to different audio signal characteristics and also of providing optimum performance at different maximum bit rate limits. It is known that certain encoders perform best at specific bit rates. This is taken into account due to the optimized mix of the two encoders, thus ensuring that optimum encoding efficiency is obtained for a large range of target bit rates. Encoding parameters of both the first and the second encoder are preferably optimized.

In principle, an encoder according to the invention allows optimization of the encoding parameters of its separate encoders in accordance with a large variety of criteria. In one embodiment, the optimizing means is adapted to adjust the encoding parameters so as to minimize the distortion measure, i.e. in accordance with this criterion, sound quality is optimized without any consideration of an available bit rate. However, this embodiment may be modified by a constraint of a predetermined maximum total bit rate for the first and second encoders.

In another embodiment, the optimizing means is adapted to minimize the distortion measure by distributing, within the predetermined maximum total bit rate, first and second bit rates to the first and second encoders, respectively. This audio encoder embodiment seeks to distribute a total bit rate most effectively between the two encoders so as to minimize distortion. In a simple embodiment of two encoders with a limited set of fixed bit rates and a constant sum of bit rates for the two encoders, the optimizing means only needs to adjust the bit rate distribution between the two encoders.

In other embodiments, the optimizing means is adapted to minimize a total bit rate for the first and second signal parts with a constraint of a predetermined maximum distortion measure. In accordance with this embodiment, the optimizing criterion is to minimize a total bit rate for a fixed measure of distortion.

In preferred embodiments, the distortion measure comprises a perceptual distortion measure. The term 'perceptual distortion measure' should be construed broadly as a quantity expressing, for example, in accordance with a psychoacoustic model, to which degree the encoded signal is distorted with respect to a perceived sound quality. In other words, the measure of perceptual distortion for the encoded signal is a quantity expressing the extent of degradation of the original input audio signal that can be perceived by a listener. Obviously, this measure should preferably be minimized in order to reach the goal of an optimal sound quality of the encoded signal.

In a preferred embodiment, the first encoder is adapted to encode the audio signal into the first encoded signal part, and the second encoder is adapted to encode a first residual signal, defined as a difference between the audio signal and the first encoded signal part, into the second encoded signal part. This embodiment describes a cascade of two encoders in which the second encoder encodes the remaining part of the original signal that is not encoded by the first encoder. The distortion measure is preferably based on a second residual signal defined as a difference between the first residual signal and the second encoded signal part. This means that the remaining part of the original audio signal that has not been encoded by the two encoders is used together with the original audio signal to create the distortion measure. In more general terms, in a cascade of more than two encoders, each of which encodes residual signals of the encoder preceding it in the cascade, a rest signal that has not been decoded by the last encoder in the cascade is used as input to the control unit for the optimizing process.

In another preferred embodiment, the audio encoder further comprises a signal splitter adapted to split the audio signal into first and second parts, wherein the first encoder is adapted to encode the first audio signal part into the first encoded signal part, and wherein the second encoder is adapted to encode the second audio signal part into the second encoded signal part. In this embodiment, first and second encoders thus operate in parallel. For example, the signal splitter may comprise a filter bank splitting the audio signal into different frequency ranges.

The audio encoder may further comprise a third encoder adapted to generate a third encoded signal part, wherein the control unit is adapted to handle a joint representation of the audio signal comprising the first, second and third encoded signal parts. The three encoders may operate in cascade in parallel, as described above, or in a combination thereof. The audio encoder may comprise more than three encoders, i.e. four, five, six or more encoders. They may be cascaded, coupled in parallel or coupled in a combination of cascade and parallel. The plurality of encoders may be of different types or may at least represent two different types.

The optimizing means is preferably adapted to select, among predetermined sets of first and second encoding templates for the first and second encoders, respectively, a pair of first and second encoding templates resulting in the best performance in accordance with the predetermined criterion. Here, 'encoding template' should be construed to mean, for a specific encoder, a selected set of encoding parameters that may be adjusted. A 'set of predetermined templates' should thus be construed to mean, for the specific encoder, sets of different selected encoding parameters.

The first encoder preferably comprises an encoder selected from the group consisting of: parametric encoders (e.g. a sinusoidal encoder), transform encoders, Regular Pulse Excitation encoders, and Codebook Excited Linear Prediction encoders. The second encoder preferably comprises an encoder selected from the same group. The first encoder may also be a combined encoder. Most preferably, the first and second encoders are of different types so that they complement each other in the best possible manner. However, the first and second encoders may be of the same type, but with different encoding templates.

The audio encoder is preferably adapted to receive an audio signal divided into segments. The optimizing means is preferably adapted to optimize the encoding parameters across one or more subsequent segments of the audio signal. These segments may be overlapping or non-overlapping. More preferably, three or more subsequent segments are used in the optimizing process.

A second aspect of the invention provides an audio decoder adapted to decode an encoded audio signal, the audio decoder comprising:

a first decoder adapted to generate a first decoded signal part from a first encoded signal part, a second decoder adapted to generate a second decoded signal part from a second encoded signal part, and summing means adapted to generate a representation of the audio signal as a sum of the first and second decoded signal parts.

The first and second decoders need to be of the same type as those used in the encoding process. Otherwise, they will be unable to decode first and second encoded signals that may comprise encoder-specific data, such as e.g. sinusoidal parameters, etc. The decoders can operate completely parallel on each part of the encoded signal.

Preferred first and second decoders may thus be selected from the corresponding types as listed above in connection with the audio encoder.

As for the audio encoder, the decoder may further comprise a third decoder adapted to generate a third decoded signal part from a third encoded signal part, wherein the summing means is adapted to generate a representation of the audio signal as a sum of the first, second and third decoded signal parts. The audio decoder may further comprise fourth, fifth, sixth or more separate decoders each adapted to decode a separate part of the encoded audio signal. All decoded signal parts should be added to generate an output audio signal.

In a third aspect, the invention provides a method of encoding an audio signal, the method comprising the steps of:

generating a first encoded signal part, using a first encoder, generating at least a second encoded signal part, using a second encoder, evaluating a joint representation of the audio signal comprising the first and second encoded signal parts with respect to a distortion measure, and optimizing encoding parameters for the first and second encoders in response to the distortion measure in accordance with a predetermined criterion.

The same explanation as for the first aspect applies.

In a fourth aspect, the invention provides a method of decoding an encoded audio signal, the method comprising the steps of:

generating a first decoded signal part from a first encoded signal part, using a first decoder, generating a second decoded signal part from a second encoded signal part, using a second decoder, adding the first and second decoded signal parts.

The same explanation as for the second aspect applies.

In a fifth aspect, the invention provides an encoded audio signal comprising first and second encoded signal parts encoded by different encoders.

The encoded signal may be a digital electric signal with a format in accordance with standard digital audio formats. The signal may be transmitted by using an electric connecting cable between two audio devices. However, the encoded signal may be a wireless signal, such as an airborne signal using a radio frequency carrier, or it may be an optical signal adapted for transmission through an optical fiber.

In a sixth aspect, the invention provides a storage medium comprising data representing an encoded audio signal according to the fifth aspect. The storage medium is preferably a standard audio data storage medium such as DVD, DVD-ROM, DVD-R, DVD+RW, CD, CD-R, CD-RW, compact flash, memory stick, etc. However, it may also be a computer data storage medium such as a computer hard disk, a computer memory, a floppy disk, etc.

In a seventh aspect, the invention provides a device comprising an audio encoder according to the first aspect.

In an eighth aspect, the invention provides an audio device comprising an audio decoder according to the second aspect.

All of the preferred devices according to the seventh and eighth aspects are different types of audio devices such as tape, disk, or memory-based audio recorders and players, for example, solid-state players, DVD players, audio processors for computers, etc. In addition, it may be advantageous for mobile phones.

Ninth and tenth aspects provide computer-readable program codes, i.e. software, comprising algorithms implementing encoding and decoding methods according to the third and fourth aspects, respectively.

BRIEF DESCRIPTION OF THE DRAWINGS

The invention will be described in more detail hereinafter with reference to the accompanying drawings, in which.

Figure 1:
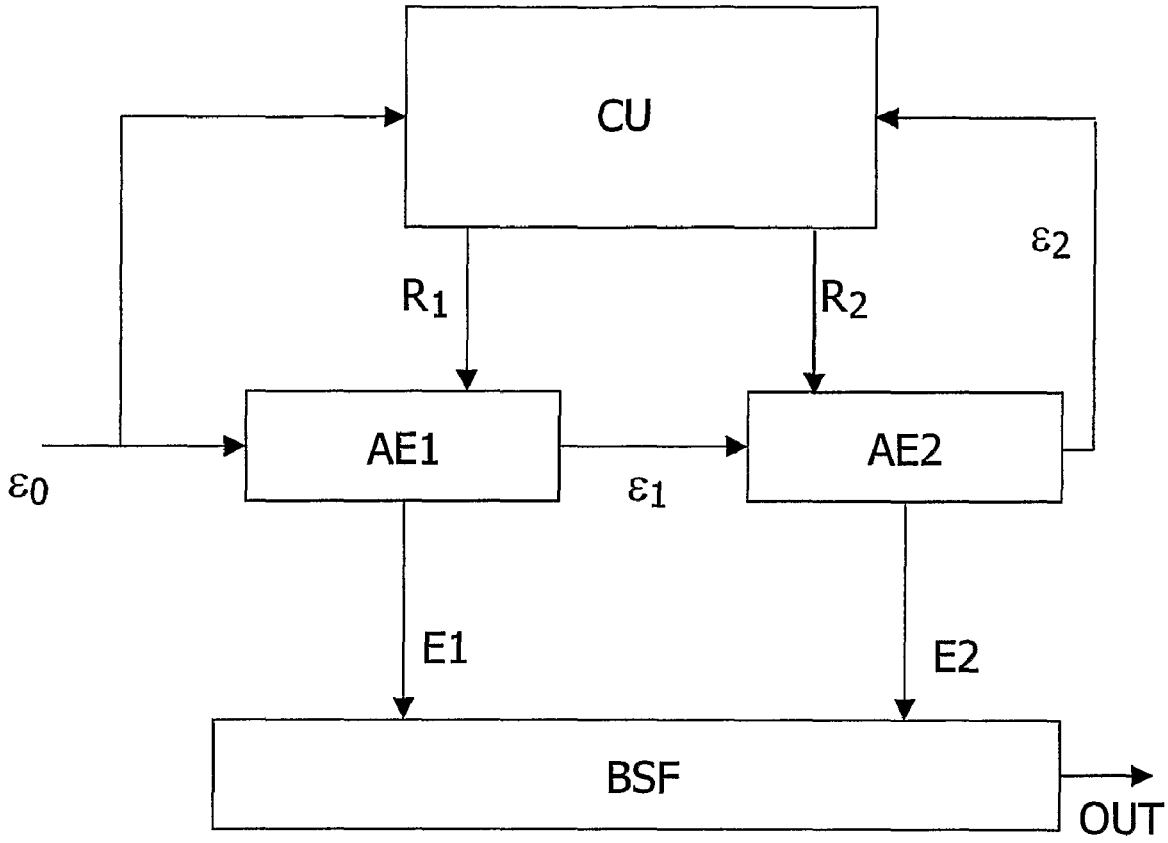
FIG. 1 is a block diagram of a first audio encoder embodiment comprising a cascade of two encoders operating under the constraint of a total target bit rate for each audio excerpt.

While various modifications and alternative forms are possible within the scope of the invention, specific embodiments have been shown by way of example in the drawings and will be described in detail hereinafter. It should be noted, however, that the invention is not limited to the particular forms disclosed. The invention rather covers all modifications, equivalents, and alternatives within the spirit and scope of the invention as defined in the appended claims.

DESCRIPTION OF EMBODIMENTS

FIG. 1 is a block diagram illustrating the principles of a first, simple encoder embodiment comprising a cascade of two different encoders AE1, AE2 operating with a fixed total target bit rate per frame. A frame is defined as a time interval which is equal to or larger in duration than a single segment. The first encoder AE1 preferably comprises a sinusoidal encoder, while the second encoder AE2 comprises a transform encoder. The sinusoidal encoding method is efficient at low bit rates and provides a better sound quality compared to waveform encoders at comparably low bit rates. Transform encoders are known to be more bit rate demanding but reach a better sound quality than sinusoidal encoders. Thus, altogether, a combination provides a flexible audio encoder.

In the encoding scheme shown in FIG. 1, an excerpt of an audio signal ϵ0 is encoded by the first encoder AE1 using a certain proportion $R_1$ of the target bit rate. The proportion of the bit rate $R_1$ that can be spent by the first encoder AE1 is controlled by the control unit CU. After sinusoidal encoding in the first encoder AE1, the first encoded signal part E1, i.e. the unquantized sinusoidal description, is subtracted from the original input signal ϵ0 to result in a residual signal ϵ1, i.e. that part of the signal that is not modelled by the sinusoidal encoder AE1. The residual signal ϵ1 is then encoded by the second encoder AE2, i.e. the waveform encoder, into a second encoded signal part E2, spending a remaining part $R_2$ of the total bit rate that is available for encoding the frame.

In this embodiment, the control unit CU will now optimize a perceived sound quality of the joint encoded signal E1, E2 by testing a number of alternative distributions of bit rates $R_1$, $R_2$ between the two encoders AE1, AE2 and evaluating the joint encoded result with respect to a perceptual distortion measure. A perceptual model is preferably used to provide a measure of perceptual distortion. A preferred model that explicitly proposes a way of predicting perceptual distortions is the one presented in [4]. Typically, this optimization needs to be done on a frame-by-frame basis to allow the encoder to adapt to local signal properties.

The control unit CU stores the perceived distortion measure for the particular distribution of bit rates $R_1$, $R_2$ among the two encoders AE1, AE2 and tries another distribution until it finds the best distribution. For this purpose, the control unit CU compares an error signal ϵ2 after the second encoder AE2 with the original input signal 80. The error signal or residual signal ϵ2 is defined as a difference between the first residual signal ϵ1 and the second encoded signal part E2, in other words, a final rest signal that has not been encoded by the two encoders AE1, AE2.

After having tested a predetermined set of bit rate distributions $R_1$, $R_2$, the control unit CU decides from the determined perceptual distortion measures the bit rate distribution $R_1$, $R_2$ resulting in the lowest perceptual distortion to be used. In accordance with this distribution $R_1$, $R_2$, resultant first and second signal parts E1, E2, i.e. parameters and data resulting from the encoders AE1, AE2, respectively, are processed by a bit stream formatter BSF so as to provide an encoded output bit stream OUT.

The predetermined set of bit rate distributions $R_1$, $R_2$ to be tested may be, for example, all combinations with a step size of 5%, 10%, 20% or 25% of a total target bit rate, i.e. $R_1+R_2$. In the case of a target bit rate of 64 kbps, for example, sets of ($R_1R_2$) can be chosen to be (0.64), (16.48), (32.32), (48.64) and (64.0) kbps.

The precise turnover point, where the sinusoidal encoder AE1 is more efficient than the waveform encoder AE2, will depend on the particular audio material that is being encoded;

e.g. one audio excerpt for a bit rate of e.g. 32 kbps may be encoded most efficiently by a sinusoidal encoder, while at the same bit rate, another audio excerpt may be encoded most efficiently with a waveform encoder.

As described above, the control unit CU tests the entire predetermined set of bit rate distributions $R_1$, $R_2$. In an alternative optimization process, the control unit CU stops testing further bit rate distribution combinations $R_1$, $R_2$ when a bit rate combination $R_1$, $R_2$ results in a measure of perceptual distortion being below a predetermined criterion value.

As a result, the embodiment described with reference to FIG. 1 results in the best use of the capabilities of the two audio encoders AE1, AE2 involved because it will be adopted for each particular audio excerpt. This leads to: 1) an automatic selection of the best audio encoder for the particular frame of audio that needs to be encoded, 2) it allows a combined use of audio encoders for the case in which this leads to better quality.

The residual signal ϵ2 that remains after the second encoder AE2 can be used as an input signal for a noise encoder (not shown). In this way, at least some of the spectral parts that are not modelled by the two encoders AE1, AE2 can be replaced by noise, which usually leads to a good quality improvement.

In a preferred implementation of the first sinusoidal encoder, AE1, a psycho-acoustical matching pursuit algorithm [5] is used to estimate sinusoids. Segmentation and distribution of sinusoids is preferably done in accordance with the method described in [6].

A preferred implementation of the second transform encoder AE2 is based on a filter bank described in [7]. Segmentation of the second encoder AE2 may either follow that of the first encoder AE1 or it may adopt a uniform segmentation.

The residual signal ϵ2 after the second encoder AE2 is preferably evaluated by the perceptual model [4] to measure a total perceptual distortion. This is preferably done by determining a masking function, v(f) for each frame of the original signal IN. Masking function is understood to be a spectral representation of the human hearing threshold given the audio signal in question as input to the human auditory system as a function of frequency f. Then the time domain residual signal ϵ2 is used to derive an error spectrum s(f) as a function of frequency f. As shown in Equation 9 of [4], the inner product of the error spectrum signal and the reciprocal of the masking function provides a good predictor of perceived distortion, i.e. perceptual distortion D can be calculated as:

$$D = \sum_f \frac{|s(f)|^2}{v(f)^2}$$

Figure 2:
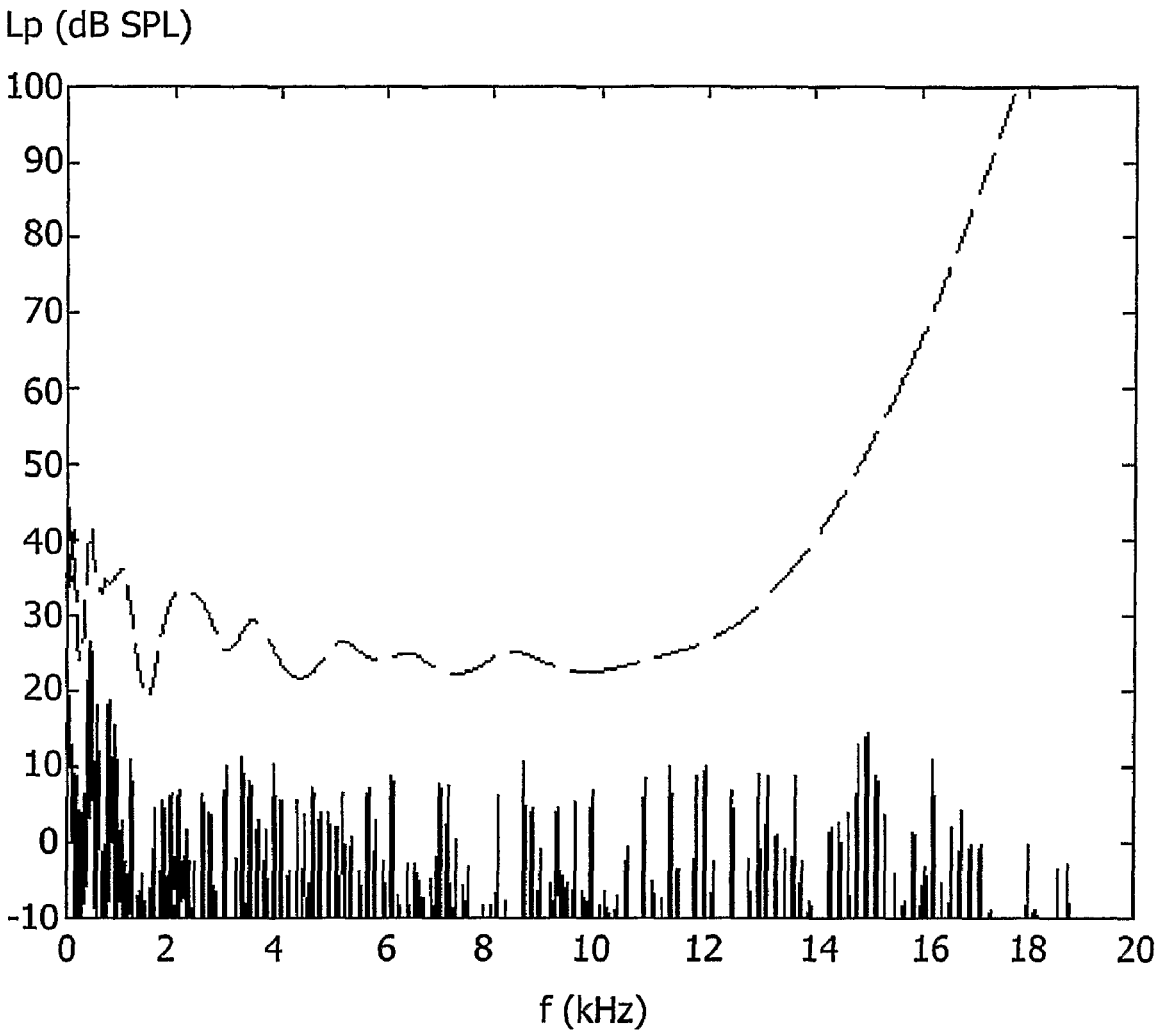
FIG. 2 shows a graph illustrating an example of a masking curve and an error spectrum used to derive the perceptual distortion measure.

FIG. 2 shows a graph illustrating an example of a masking curve v(f), indicated by a broken line, calculated by the mentioned perceptual model, together with an error spectrum s(f), indicated by a solid line, which are used to derive the perceptual distortion measure D as indicated above. The graph shows a linear frequency scale f versus level, Lp, in dB. FIG. 2 shows that at lower frequencies, e.g. around 100 Hz, the error signal s(f) has a significant level compared to the masking curve v(f) and this frequency range thus contributes to the total perceptual distortion D. Above 10-12 kHz, the rising masking curve is primarily caused by the rise in the human hearing threshold in silence.

Figure 3:
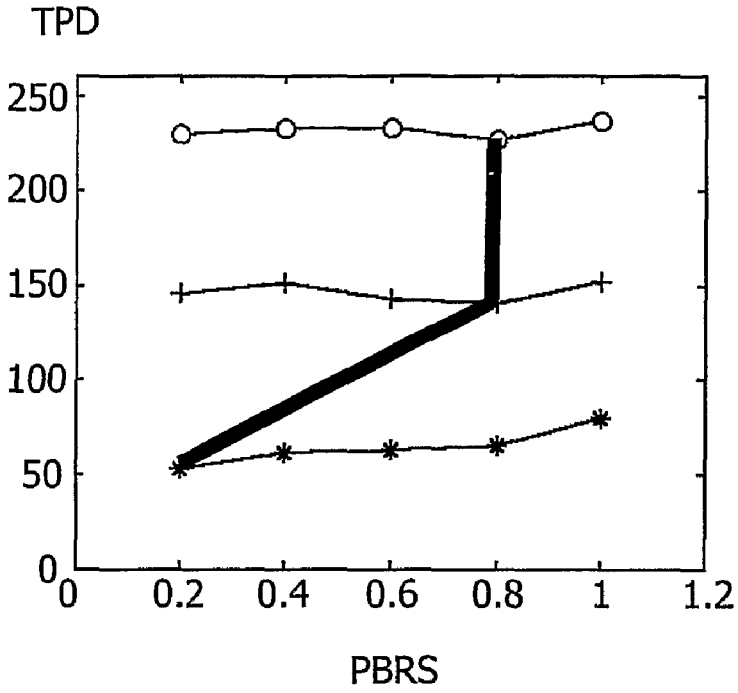
FIG. 3 shows graphs illustrating, for two different sound examples, the influence of the distribution of bit rates between first and second encoders on a resultant total perceptual distortion.
Figure 3:
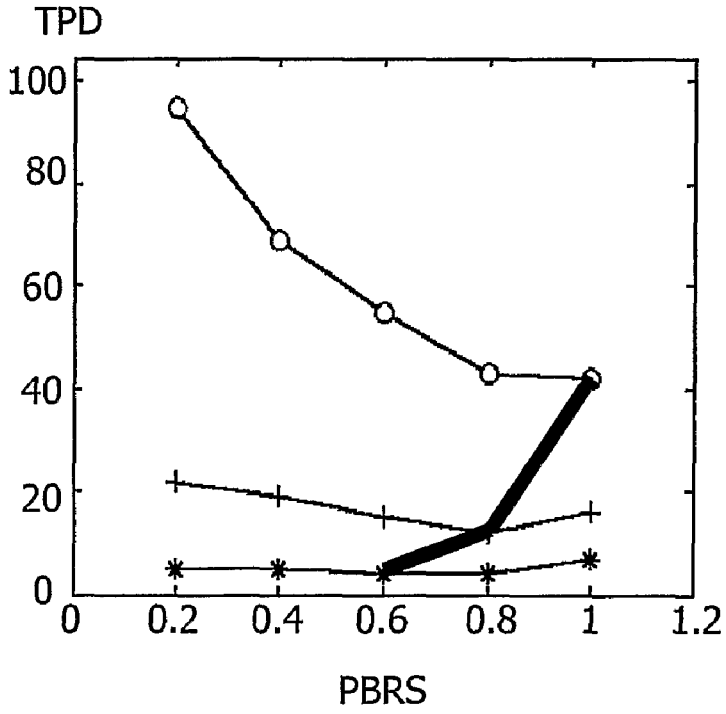

FIG. 3 shows two graphs illustrating, for different audio signals, the dependence of total perceptual distortion TPD on a portion of the bit rate allocated to a sinusoidal encoder PBRS in the case of an audio encoder with a sinusoidal encoder and a waveform, such as described with reference to FIG. 1. The different audio signals represent sound recorded from castanets, upper graph, and harpsichord, lower graph. The symbols indicate different total bit rates: 12 kbps (circles), 24 kbps (pluses), and 48 kbps (stars). The bold lines indicate the choice of bit rate distribution for the various total bit rates.

As can be seen for the castanets, upper graph, the perceptual distortions are fairly constant as a function of bit rate distribution, at least at 12 kbps (circles) and 24 kbps (pluses). However, for 48 kbps (stars), it is clearly advantageous to send most of the bit rate to the waveform encoder as compared to sending most of the bit rate to the sinusoidal encoder. For the harpsichord, lower graph, a different picture emerges. Here it is clear that, even at high bit rates, the sinusoidal encoder should receive about half of the bit rate, while at low bit rates, it is clearly better to use the full bit rate for the sinusoidal encoder.

Note that although the examples shown in FIG. 3 were obtained by evaluating and optimizing complete audio excerpts, this optimization method is thought to be used on shorter segments of audio such that the bit rate $R_1$, $R_2$ distribution can be adapted more locally to the signal properties.

Figure 4:
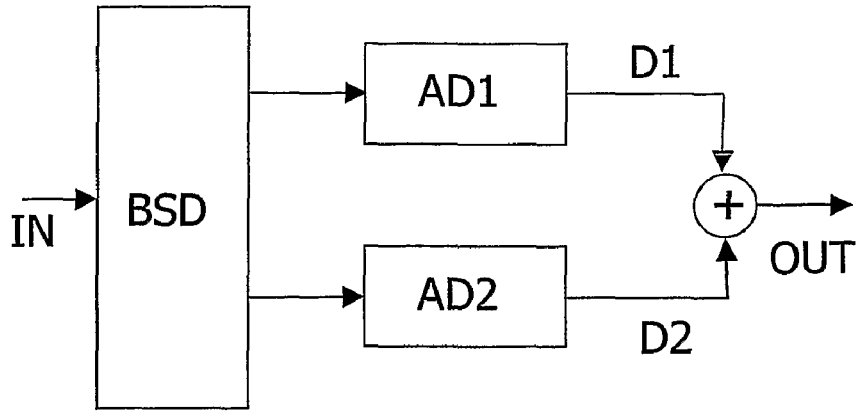
FIG. 4 is a block diagram of an audio decoder comprising two decoders.

FIG. 4 is a block diagram of an audio decoder adapted to decode an encoded audio signal, for example, an audio signal encoded by the audio encoder described with reference to FIG. 1. The audio decoder comprises first and second decoders AD1, AD2 corresponding to the types of the first and second encoders AE1, AE2 so that they are adapted to receive the first and second encoded signal parts E1, E2 from the encoders AE1, AE2. A decoded audio signal is received in an input bit stream IN, and the first and second decoded signal parts E1, E2 are extracted by a bit stream decoder BSD. Then the first decoded signal part E1 is applied to the first decoder AD1, and the second decoded signal part E2 is applied to the second decoder AD2. The decoders AD1, AD2 can independently decode their parts, and the resultant first and second decoded signal parts D1, D2 can then simply be added so as to generate a representation OUT of the original audio signal.

Figure 5:
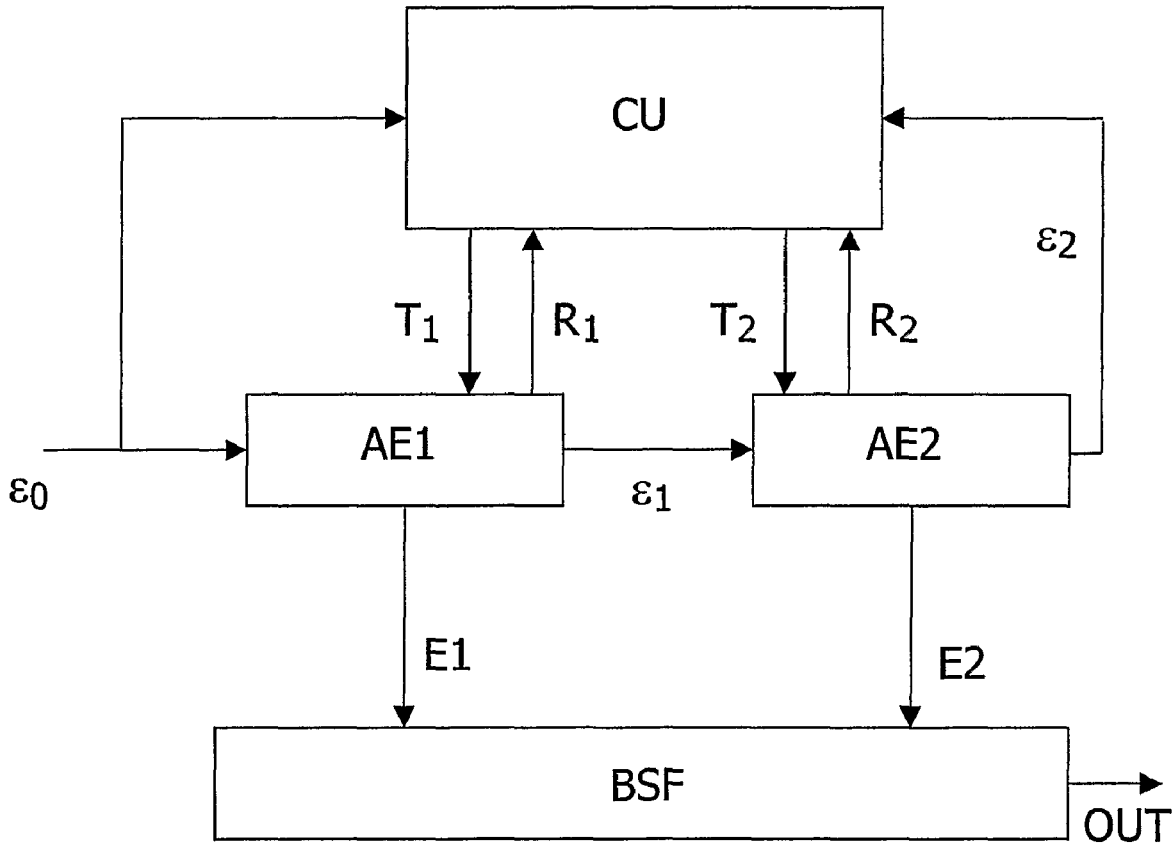
FIG. 5 illustrates a second encoder embodiment comprising a cascade of two encoders operating, for each audio excerpt, with a number of possible encoding templates.

FIG. 5 is a block diagram of another audio encoder embodiment comprising a cascade of first and second separate encoders AE1, AE2. Where the encoding scheme described in connection with the first embodiment, shown in FIG. 1, operates under the constraint of a constant total bit rate ($R_1$+$R_2$) for each predetermined time interval or segment, this constraint is relaxed in the second embodiment of FIG. 5. This second embodiment considers, in principle, all possible encoding parameters of at least the first encoder AE1, preferably also of the second encoder AE2, and this also results in a reduced perceptual distortion compared to the first audio encoder of FIG. 1. However, compared to the first audio encoder embodiment, the second audio encoder embodiment is more complicated to implement. In contrast to the first embodiment, the second embodiment thus allows a bit rate adaptable to the demands of each audio signal excerpt, which allows a better optimization of the two encoders AE1, AE2 and, consequently, the second audio encoder embodiment is able to achieve a lower perceptual distortion, i.e. a higher sound quality, at the same bit rate considered as an average of a large number of audio excerpts.

In the audio encoder of FIG. 5, the first and second different encoders AE1, AE2 are each adapted to encode a received input signal ϵ0 in many different ways. These encoding options are called encoding templates. For example, in the case of a sinusoidal encoder, one particular encoding template specifies one particular set of sinusoids that is used to represent an input audio segment, while a different template may specify a different set of sinusoids. The set of all possible templates therefore enables the encoder to perform every encoding operation that is possible and is thus able to adapt its encoding to each audio excerpt. Templates for the first and second encoders AE1, AE2 are denoted first and second templates $T_1$, $T_2$, respectively.

For every two encoding templates $T_1$ and $T_2$ that are selected, the first encoder AE1 encodes an audio input signal ϵ0 into a first encoded signal part E1. Due to imperfect encoding, the encoding results in a residual signal ϵ1 which is then encoded by the second encoder AE2 into a second encoded signal part E2. The second encoding process again results in a residual signal ϵ2 which is evaluated by a control unit CU using a perceptual model resulting in a calculation of a measure of perceptual distortion. In order to decide upon a final encoding of the input audio signal ϵ0, the control unit CU performs an optimizing procedure with the aim of finding the encoding templates $T_1$, $T_2$ from a predetermined set of allowed encoding templates $T_1$, $T_2$ that result in the lowest measure of perceptual distortion. For this purpose, besides the measure of perceptual distortion, also bit rates $R_1$, $R_2$ (or estimates thereof) of each of the two encoders AE1, AE2 are taken into account.

Once the final encoding templates $T_1$, $T_2$ have been found, these templates $T_1$, $T_2$ are used to generate first and second encoded signal parts E1, E2 resulting from the first and second encoders AE1, AE2, respectively. These first and second encoded signal parts E1, E2 are applied to a bit stream formatter BSF that forms an output bit stream OUT.

The first encoder AE1 preferably comprises a sinusoidal encoder, while the second encoder AE2 comprises a transform encoder. The measure of perceptual distortion D is preferably calculated in accordance with [4] as described in connection with the first encoder embodiment.

The formal definition of the optimizing problem that has to be solved by the control unit CU is given by $$\arg_{T_1(n)T_2(n)} \min \sum_{n=1}^{N} D_2(T_1(n), T_2(n), n)$$

wherein $D_2$ is calculated on the basis of ϵ2 and represents the perceptual distortion as predicted by a perceptual model (e.g. [4]) and n is the segment number, assuming that the signal will be encoded by a number of short time segments taken from the total input signal ϵ0. This minimization problem has to be minimized under the constraint $$c: \sum_{n=1}^{N} (R_1(T_1(n), n) + R_2(T_1(n), T_2(n), n)) \leq R_T$$

wherein $R_T$ is the target bit rate.

When solving this problem in the way it is formulated here, in principle, all combinations of encoding templates $T_1$, $T_2$ have to be tested in order to find the solution to this minimization problem. Assuming that for each segment there are M encoding templates for the first and second encoders AE1, AE2, respectively, the total number of combinations that need to be tested is $$\#=M^{2N}$$

For any practical situation, this problem is effectively unsolvable and a more efficient solution will therefore be presented hereinafter. However, the core idea still is to solve the problem stated here, or at least some derivative thereof. It is known from the constraint optimization theory that these types of problems can be reformulated in such a way that they are divided into a number of independent optimization problems that need to be solved per segment. This can be done under the constraints that the bit rates $R_1$, $R_2$ of the two encoders AE1, AE2 are independent and additive across segments. Similarly, the perceptive distortion measures across segments need to be additive and independent.

Note that the solution to this problem will result in a minimization of the perceptual distortion such as predicted by the perceptual distortion measure subject to an overall bit rate constraint. By implication, the bit rate may vary from segment to segment. In addition, the perceptual distortion will not be constant across segments. However, allowing these variations across segments will result in a lower overall perceptual distortion than when either the bit rate or the perceptual distortion would be kept constant for each segment.

Under the constraints given above, the problem can be reformulated by defining N independent cost functions that need to be minimized:

$$J(T_1(n),T_2(n),n)=D_2(T_1(n),T_2(n),n)+\lambda[R_1(T_1(n),n)+R_2(T_1(n),T_2(n),n)] \quad \text{(I)}$$

The problem that needs to be solved is now finding λ such that:

$$\lambda = \arg\sup_{\lambda} \left( \left[ \sum_{n=1}^{N} J(T_{1,2min}(n), n) \right] - \lambda R_T \right) \quad \text{(II)}$$

with $T_{1,2\ min}(n)$ chosen to be such that:

$$T_{1,2min}(n) = \arg\min_{T_1(n)T_2(n)} J(T_1(n), T_2(n), n) \quad \text{(III)}$$

The advantage of this reformulation of the problem is that now N independent problems are connected via the Lagrange multiplier λ. In practice, this means that an initial value of λ is chosen. With this value, the minimizations given in Eq. (III) can be solved independently for each segment n. After these optimizations, it can be checked whether Eq. (II) is satisfied. Based on the difference between the target rate $R_T$ and the total bit rate used, λ can be adapted. This process can be repeated until the best, or a satisfactory, value of λ has been found (based on Eq. II).

Solving the optimization problem stated in Eq. (III) implies testing all combinations of encoding templates $T_1$, $T_2$ for the particular segment n under consideration. For specific individual encoders AE1, AE2, it is usually possible to select a subset of encoding templates $T_1$, $T_2$ from all possible encoding templates $T_1$, $T_2$ when it is known a priori that templates falling outside the subset will lead to non-optimal solutions. For the joint optimization given in Eq. (III), the dependence between the two encoders AE1, AE2 makes it more difficult to discard certain encoding templates $T_1$, $T_2$ a priori from consideration in the optimization process. However, when encoding template T, is assumed to be known, it is possible to make a selection of templates $T_2$ that do not need to be considered in the optimization process because the templates $T_2$ apply to the last encoder AE2 in line, more specifically, the particular encoding template $T_2$ that is chosen for the second encoder AE2 will not influence the encoding of the first encoder AE1. For the first encoder AE1, this is not possible because the choice of T, will influence the behavior of the second encoder AE2 (see Eq. I, wherein $R_2$ depends on both $T_1$ and $T_2$). Therefore, it is not possible to discard encoding templates T, for encoder AE1 without considering the effect it has on encoder AE2. Restricting the total set of encoding templates T, for encoder AE1 is inherently much more difficult to achieve. However, to reduce computational complexity, it is possible to restrict the number of candidate templates T, for encoder AE1, e.g. by assuming that the first encoder AE1 operates in isolation.

In practice, the optimization problem stated in Eq. (III) is thus solved by first selecting an encoding template T, and then calculate the residual $\epsilon_1$ which is presented to encoder AE2. Since T, is known, the second encoder AE2 optimizes in accordance with a simplified version of Eq. (III):

$$\arg\min_{T_2(n)} J'(n) = D_2(T_1(n), T_2(n), n) + \lambda[R_2(T_1(n), T_2(n), n)] \quad \text{(IV)}$$

As mentioned above, it is possible to solve this optimization in most choices of the second encoder AE2 without considering all possible encoding templates $T_2$. After the minimization has been solved, a new template T, for the first encoder AE1 can be selected until the best solution of Eq. (I) has been found for the segment under consideration.

Thus the solution given in this section can be summarized in the following algorithm (A1): Finding the optimal encoding templates $T_1$, $T_2$ for each segment plus the Lagrange multiplier $\lambda$, such that the target bit rate is met.

```
(A1):
Find λ:
    Loop n:
        Loop T1(n):
        Encode ε0 with encoder AE1
            Loop T2(n):
                Encode ε1 with encoder AE2
                Derive J'(n) (see Eq. IV)
                Remember best T2(n) and J'(n)
            End Loop T2(n)
            Derive J(n) (see Eq. I)
            Remember best T1(n), T2(n) and J(n)
        End Loop T1(n)
    End Loop n
    Update λ
End Find λ
```

In (A1), the loop over $T_1$ is used to find the best solution to Eq. (III), e.g. to minimize the global cost function. As part of this problem, there is a loop over $T_2$ which minimizes the cost function for the second encoder AE2 given in Eq. (IV).

Note that, in the way the problem is formulated here, the optimization is performed over a number of segments at the same time. Within this set of segments, the bit rate is allowed to vary across segments. In many practical situations, only a limited set of segments can be evaluated at the same time. There are two options to handle this contraint:

1) $\lambda$ is determined for each set of segments, each time such that the bit rate within the set of segments meets the required target bit rate.

2) $\lambda$ is adapted after each set of segments to compensate for the mismatch between bit rate and target bit rate in past encoding operations.

It will hereinafter be assumed that the encoder AE1 of FIG. 5 is a sinusoidal encoder and the second encoder AE2 is a transform encoder. For the first encoder AE1, not all encoding templates $T_1$ will be considered. Only encoding templates $T_1$ are considered that minimize the cost function for a certain $\lambda_1(n)$:

$$J_1(n)=D_1(T_1(n),n)+\lambda_1(n)R_1(T_1(n),n) \quad \text{(V)}$$

wherein $D_1$ is the perceptual distortion measured after encoding by the first encoder AE1.

The two encoders AE1, AE2 have the same segmentation and each encoder AE1, AE2 uses overlapping segments in the encoding and decoding stage. This requires a refinement of algorithm (A1) because the residual signal $\epsilon_1(n)$ needed for encoding segment 71 by encoder 2 will depend on the encoding templates $T_1(n-1)$, $T_1(n)$, and $T_1(n+1)$.

Figure 6:
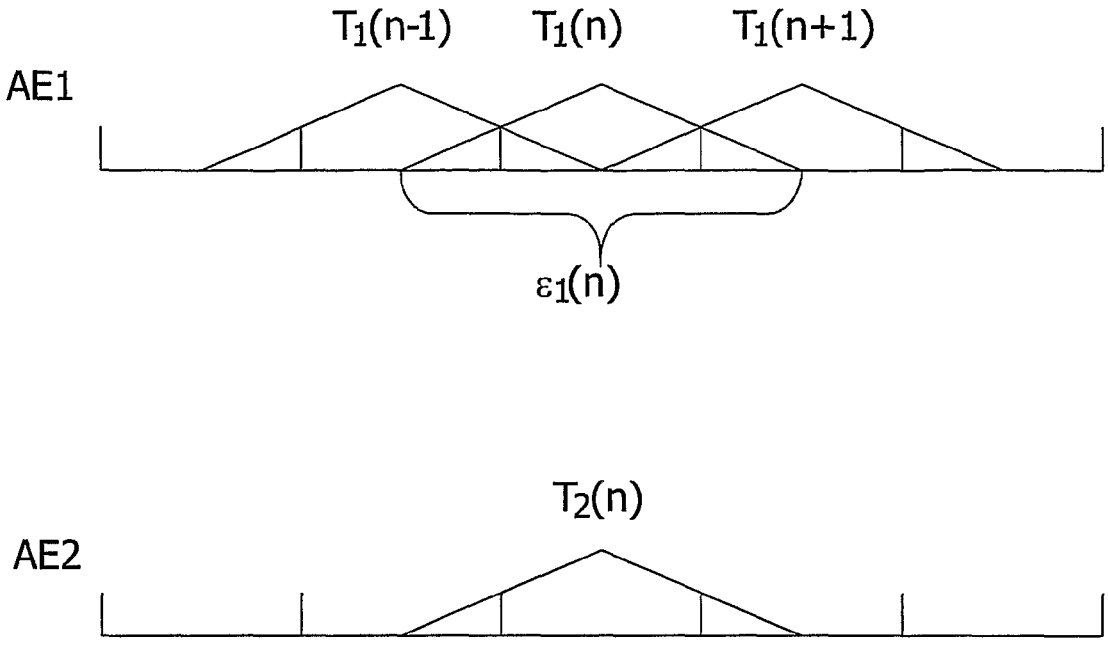
FIG. 6 illustrates an example of segmentation and overlap between the two encoders of the second encoder embodiment.

To clarify this problem, FIG. 6 shows an example of segmentation and overlap, signified by triangular windows, between segments for the two encoders AE1, AE2 including encoding templates. As can be seen in FIG. 6, the residual signal E>(n), after the first encoder AE1 depends on the encoding templates T1 that were chosen for the first encoder AE1 in segments, n−1, n, and n+1. Typically, encoding template $T_1(n+1)$ will not be known when segment n is optimized because segments are optimized one at a time in a sequential order (see algorithm (A1)). However, encoding template $T_1(n-1)$ is known when segment n is optimized although it may not be the best solution because it will also depend on solutions found in segment n.

A practical solution is to take $T_1(n-1)$ such as found in the optimization of the previous segment (n−1). For the next segment, an informed guess will be made as to what will be the final encoding that will be done for encoder AE1 for segment n+1. For this purpose, an average $\lambda_1$ of the most recent segments will be used to select the best encoding template $T_1(n+1)$ in accordance with Eq. V. Based on this, the residual signal $\epsilon_1(n)$, can be calculated and now the best $T_2(n)$ can be found subject to $\lambda$ in accordance with (A1).

Note that the final value of $\epsilon_1(n-1)$ is known only when $T_1(n)$ has been finalized and only then the final $T_2(n-1)$ can be found.

For clarity's sake, a more detailed version (A2) of algorithm (A1) is given below, including the practical solution outlined above. (A2) finds optimal encoding templates $T_1$, $T_2$ for each segment plus the Lagrange multiplier $\lambda$ such that the target bit rate is met. Overlap between segments is taken into account.

```
(A2):
Find λ:
  Loop n:
    Loop T1(n):
      Encode ε0(n) with encoder AE1 and T1(n)
      Encode ε0(n+1) with encoder AE1 and informed
      guess of
      T1(n+1)
      Retrieve ε1(n) based on ε0(n−1), ε0(n), ε0(n+1) with T1(n−1),
      T1(n),
      T1(n+1)
      Loop T2(n):
        Encode ε1(n) with encoder AE2
        Derive J'(n) (see Eq. IV)
        Remember best T2(n) and J'(n)
      End Loop T2(n)
```

-continued

```
        Derive J(n) (see Eq. I)
        Remember best T1(n), T2(n) and J(n)
    End Loop T1(n)
    # Now the final solution for T1(n) has been found
    # the final ε1(n−1) is known and the final T2(n−1) can be found
    Loop T2(n−1):
        Encode ε1(n−1) with encoder AE2
        Derive J'(n−1) (see Eq. IV)
        Remember best T2(n−1) and J'(n−1)
    End Loop T2(n−1)
    End Loop n
    Update λ
End Find λ
```

The optimization problem to be solved in connection with the encoder embodiment shown in FIG. 1 will now be described. In this embodiment, the problem of overlapping windows, as described for the embodiment of FIG. 5, is overcome by making $\lambda_1$ constant over N subsequent segments, and the corresponding encoding templates $T_1(1) \ldots T_1(N)$ are applied to encoder AE1 each of which minimizes Eq. (V). In this case, all of the N segments for the first encoder AE1 can be derived first. For the second encoder AE2, subject to $\lambda$, encoding templates $T_2(1) \ldots T_2(N-1)$ can be found which minimize Eq. (IV). In this way, several values of $\lambda_1$ can be tested until the one has been found that minimizes Eq. (I). This can be tested for several values of $\lambda$, until the target bit rate has been met with the lowest possible perceptual distortion. After the solutions for segment $1 \ldots N-1$ have been found, the next segments $N \ldots 2N-1$ will be optimized. Below, algorithm (A3) summarizes the principle of finding the optimal encoding templates $T_1$ and $T_2$ for each segment plus the Lagrange multiplier $\lambda$ such that the target bit rate is met, taking into account overlap between segments by keeping $\lambda_1$ constant.

```
(A3):
Find λ:
    Loop λ1:
        Loop n1 (1...N):
            Encode ε0(n1) with AE1 and use λ1 to min. J1(n1) see
            Eq. (V)
        End Loop n1
        Loop n2 (1...N−1):
            Encode ε1(n2) with AE2 and use λ to min. J'(n2) see Eq.
            (IV)
        End Loop n2
        Add all cost functions J(n2)
        Remember best λ1 and corresp. best templates for both encoders
        AE1, AE2
    End Loop λ1
    Remember best λ and corresponding best templates for both encoders
    AE1, AE2
End Find λ
```

Note that the number of nested loops may seem to be one less in algorithm (A3) than in (A2). This is, however, not true because the encodings subject to $\lambda_1$ and $\lambda$ require an additional loop to obtain the corresponding encoding templates.

An advantage of algorithm (A3) is that the segmentation of the two encoders AE1, AE2 does not need to be aligned. The only requirement is that the temporal interval (comprised by e.g. segment numbers n=1 . . . N) that is encoded by encoder AE1 is at least as large as the temporal interval encoded by encoder AE2 each time.

Algorithm (A3) has been implemented and tested with the only difference that the loop over $n_2$ runs up to N instead of N−1. This leads to minor reductions in encoding accuracy at the end of the N segments, but these effects did not seem to affect quality. In the implementation, the first encoder AE1 used a different and flexible segmentation; see [6], while the second encoder AE2 used a fixed segmentation.

Two cascaded encoders have been used in the encoder embodiments described so far. However, according to the invention, the number of cascaded encoders can be extended easily to more than two encoders. Two scenarios may be distinguished:

All encoding templates are considered (e.g. no restriction is applied to the candidate templates). In this case, the first encoder can be replaced by a cascade of two (or more) encoders. The encoding templates of each of these separate encoders will be joined together for each segment into a larger set of encoding templates that entail all possible combinations of encoding templates. Now the problem can be solved as if there were only two encoders present in cascade.

Not all encoding templates are considered, only the ones that minimize a cost function such as given in Eq. (V). In this case, the second encoder is thought of as a cascade of two encoders which are optimized subject to $\lambda$. This 'nested' extension can be continued up to a larger number of cascaded encoders.

Figure 7:
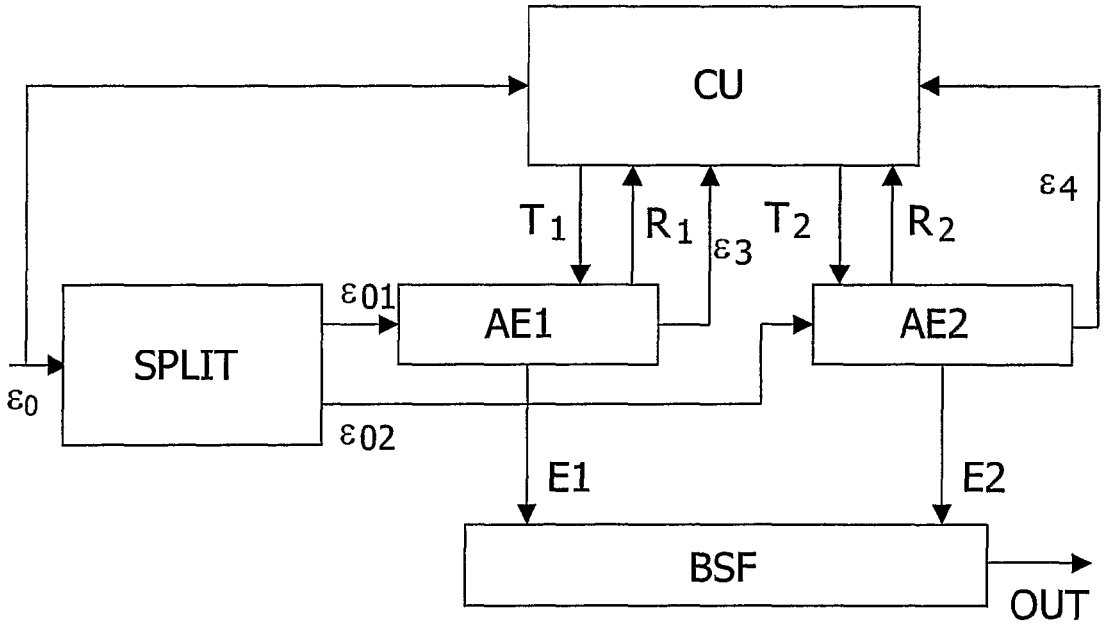
FIG. 7 illustrates a third encoder embodiment comprising two encoders operating in parallel.

FIG. 7 shows a third audio encoder embodiment comprising two encoders AE1, AE2 operating in parallel. It differs from the second encoder embodiment of FIG. 5 in that an audio input signal go is split by a splitting unit SPLIT into first and second signal parts $\epsilon_1$, $\epsilon_2$ which, when added together, constitute the input signal $\epsilon_0$. The two signals $\epsilon_1$ and $\epsilon_2$ are applied to the first and second encoders AE1, AE2, respectively.

A control unit CU of the third audio encoder embodiment of FIG. 7 presents encoding templates $T_1$, $T_2$ to the first and second encoders, respectively, to perform their encoding. Thus, for every two encoding templates $T_1$ and $T_2$ that are selected, encoder AE1 processes the first signal part $\epsilon_{01}$ and, independently, encoder AE2 processes the second signal part $\epsilon_{02}$. The encoders AE1, AE2 will generate residual signals $\epsilon_3$ and $\epsilon_4$, respectively, which are applied to the control unit which, in accordance with a perceptual model, calculates a measure of perceptual distortion which is then used to find the best encoding templates $T_1$, $T_2$ from a set of allowed encoding templates $T_1$, $T_2$ to decide upon the final encoding of the signal. For this purpose, not only the perceptual distortion measure but also the bit rates $R_1$, $R_2$ (or estimates thereof) of each of the two encoders AE1, AE2 are taken into account. As mentioned for the first and second audio encoder embodiments, the model in [4] can be used to calculate a measure of perceptual distortion D.

The formal definition of the problem that has to be solved by the control unit 110 in the third audio encoder embodiment is given by $$\arg \min_{T_1(n) T_2(n)} \sum_{n=1}^{N} D_1(T_1(n), n) + D_2(T_2(n), n)$$

wherein $D_1$ and $D_2$ are calculated on the basis of $\epsilon_3$ and $\epsilon_4$, respectively. It is assumed that the perceptual distortions can simply be added. The parameter n is the segment number, assuming that the signal will be encoded by a number of short time segments taken from the total input signal. This minimization problem has to be minimized under the constraint $$c: \sum_{n=1}^{N} R_1(T_1(n), n) + R_2(T_2(n), n) \leq R_T$$

wherein $R_T$ is the target bit rate.

Under the constraints given in the previous section, the problem can be reformulated by defining 2N independent cost functions that need to be minimized:

$$J_1(T_1(n),n)=D_1(T_1(n),n)+\lambda R_1(T_1(n),n) \quad \text{(VI)}$$

$$J_2(T_2(n),n)=D_2(T_2(n),n)+\lambda R_2(T_2(n),n) \quad \text{(VII)}$$

The problem that needs to be solved is now finding λ such that:

$$\lambda = \arg\sup_{\lambda}\left\{\left[\sum_{n=1}^{N} J_1(T_{1min}(n), n) + J_2(T_{2min}(n), n)\right] - \lambda R_T\right\} \quad \text{(VIII)}$$

with $T_{1min}(n)$ and $T_{2min}(n)$ chosen to be such that:

$$T_{1min}(n) = \underset{T_{1min}(n)}{\arg\min} J_1(T_1(n), n) \quad \text{(IX)}$$

$$T_{2min}(n) = \underset{T_{2min}(n)}{\arg\min} J_2(T_2(n), n) \quad \text{(X)}$$

The advantage of this reformulation of the problem is that there are now 2N independent problems connected via the Lagrange multiplier λ. In practice, this means that an initial value of λ is chosen. With this value, the minimizations given in Eqs. (IX) and (X) can be solved independently for each segment n and each encoder. After the optimizations, it can be checked whether Eq. (VIII) is satisfied. Based on the difference between the target rate $R_T$ and the total bit rate used $(R_1+R_2)$, λ can be adapted. This process can be repeated until the best (or a satisfactory) value of λ has been found (based on Eq. (VIII)).

Since the optimization in this parallel case is separated and made independent for the individual encoders AE1, AE2 it is, in principle, possible to select a subset of encoding templates $T_1$, $T_2$ from all possible encoding templates $T_1$, $T_2$ because it is known a priori due to the properties of the particular encoder AE1, AE2 that the templates $T_1$, $T_2$ falling outside the subset will lead to non-optimal solutions. This is a considerable advantage of the parallel encoder compared to cascaded encoders.

The parallel optimization described above can easily be extended to more than two encoders, as will be understood from the nature of Eqs. (VI) to (X).

In a preferred embodiment of the parallel encoder of FIG. 4, the input signal splitter SPLIT comprises a Modified Discrete Cosine Transform (MDCT) filter bank adapted to split input segments of the audio input signal ϵ0 into transform coefficients. The transform coefficients are split into groups each representing scale factor bands which are encoded separately. For each scale factor band in each segment, a scale factor and a coding book has to be selected, such that it minimizes cost functions as given in Eqs. (VI) and (VII) subject to the same value of λ. Different code book designs may be used for the various scale factor bands to optimally exploit the different statistics of transform coefficients in different scale factor bands. After optimization of all individual scale factor bands across segments, the total bit rate is calculated and λ is adapted to reach the target bit rate.

Encoders and decoders according to the invention may be implemented on a single chip with a digital signal processor. The chip can then be built into audio devices independent of the signal processor capacities of such devices. The encoders and decoders may alternatively be implemented purely by algorithms running on a main signal processor of the application device.

In the claims, reference signs are included for reasons of clarity only. These references to examples of embodiments in the Figures should not be construed as limiting the scope of the claims.

LIST OF REFERENCES

[1] Scott N. Levine, "Audio Representations for Data Compression and Compressed Domain Processing" Ph.D. Dissertation, Dec. 2, 1998.

[2] Wuppermann et. al. "Transmission system implementing different coding principles", U.S. Pat. No. 5,808,569.

[4] S. van de Par, A. Kohlrausch, G. Charestan, R. Heusdens (2002), "A new psychoacoustical masking model for audio coding applications"*IEEE Int. Conf. Acoust., Speech and Signal Process*., Orlando, USA, 2002, pp. I-1805-1808.

[5] R. Heusdens, R. Vafin, W. B. Kleijn (2002), "Sinusoidal modeling using psychoacoustical matching pursuits" *IEEE Signal Processing Lett.,* 9(8), pp. 262-265.

[6] R. Heusdens and S. van de Par (2002) "Rate-distortion optimal sinusoidal modeling of audio and Speech using psychoacoustical matching pursuits", *IEEE Int. Conf. Acoust., Speech and Signal Process*., Orlando, USA, 2002, pp. II-1809-1812.

[7] J. Princen and A. Bradley (1986) "Analysis/synthesis filter bank design based on time domain aliasing cancellation" *IEEE Trans. Acoust., Speech, Signal Processing,* 34 pp. 1153-1161.

The invention claimed is:

1. An audio encoder arrangement for encoding an audio signal, the audio encoder arrangement comprising:

an input for receiving an audio signal;

a first encoder, implemented in hardware, coupled to the input for generating a first encoded signal part;

at least a second encoder, implemented in hardware, coupled to said first encoder for generating a second encoded signal part; and a control unit comprising:

evaluation means for evaluating a joint representation of the audio signal comprising the first and second encoded signal parts with respect to a distortion measure; and optimizing means for adjusting encoding parameters for at least one of the first and second encoders, and for monitor the distortion measure of the joint representation of the audio signal in response thereto, so as to optimize the encoding parameters in accordance with a predetermined criterion.

2. The audio encoder arrangement as claimed in claim 1, wherein the distortion measure comprises a perceptual distortion measure.

3. The audio encoder arrangement as claimed in claim 1, wherein the optimizing means adjusts the encoding parameters so as to minimize the distortion measure.

4. The audio encoder arrangement as claimed in claim 3, wherein the optimizing means minimizes the distortion measure under a constraint of a predetermined maximum total bit rate for the first and second encoders.

5. The audio encoder arrangement as claimed in claim 4, wherein the optimizing means minimizes the distortion measure by distributing, within the predetermined maximum total bit rate, first and second bit rates to the first and second encoders, respectively.

6. The audio encoder arrangement as claimed in claim 1, wherein the first encoder encodes the audio signal into the first encoded signal part, and wherein the second encoder encodes a first residual signal, defined as a difference between the audio signal and the first encoded signal part, into the second encoded signal part.

7. The audio encoder arrangement as claimed in claim 6, wherein the distortion measure is based on a second residual signal defined as a difference between the first residual signal and the second encoded signal part.

8. The audio encoder arrangement as claimed in claim 1, wherein said audio encoder arrangement further comprises a signal splitter for splitting the audio signal into first and second parts, wherein the first encoder encodes the first audio signal part into the first encoded signal part, and wherein the second encoder encodes the second audio signal part into the second encoded signal part.

9. The audio encoder arrangement as claimed in claim 1, wherein the optimizing means minimizes a total bit rate for the first and second signal parts under a constraint of a predetermined maximum distortion measure.

10. The audio encoder arrangement as claimed in claim 1, wherein the first encoder comprises an encoder selected from the group consisting of: parametric encoders, transform encoders, subband encoders, Regular Pulse Excitation encoders, and Codebook Excited Linear Prediction encoders.

11. The audio encoder arrangement as claimed in claim 1, wherein the second encoder comprises an encoder selected from the group consisting of: parametric encoders, transform encoders, subband encoders, Regular Pulse Excitation encoders, and Codebook Excited Linear Prediction encoders.

12. The audio encoder arrangement as claimed in claim 1, wherein the audio encoder arrangement receives an audio signal divided into non-overlapping segments, and wherein the optimizing means optimizes the encoding parameters across one or more subsequent segments of the audio signal.

13. The audio encoder arrangement as claimed in claim 1, wherein the audio encoder arrangement receives an audio signal divided into overlapping segments, and wherein the optimizing means optimizes the encoding parameters across one or more subsequent segments of the audio signal.

14. The audio encoder arrangement as claimed in claim 1, wherein said audio encoder arrangement further comprises a third encoder for generating a third encoded signal part, and wherein the control unit handles a joint representation of the audio signal comprising the first, second and third encoded signal parts.

15. A device comprising an audio encoder as claimed in claim 1.

16. A method of encoding an audio signal, the method comprising the steps of:

generating a first encoded signal part, using a first encoder implemented in hardware;

generating at least a second encoded signal part, using a second encoder, implemented in hardware;

evaluating a joint representation of the audio signal comprising the first and second encoded signal parts with respect to a distortion measure; and optimizing encoding parameters for the first and second encoders in response to the distortion measure in accordance with a predetermined criterion.

17. A non-transitory computer-readable storage medium haying program code encoded thereon, said program code, when loaded on a computer, causing the computer to encode an audio signal according to the method as claimed in claim 16.

* * * * *